US011085604B2

(12) United States Patent
Grave et al.

(10) Patent No.: US 11,085,604 B2
(45) Date of Patent: Aug. 10, 2021

(54) HOLDER FOR VEHICLE SIGNALING LIGHT

(71) Applicant: LUMILEDS LLC, San Jose, CA (US)

(72) Inventors: Manuel Grave, Aachen (DE); Sergej Kunz, Eschweiler (DE); Ralph Hubert Peters, Kerkrade (NL); Adam Lind, Aldenhoven (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/646,879

(22) PCT Filed: Sep. 5, 2018

(86) PCT No.: PCT/EP2018/073825

§ 371 (c)(1),
(2) Date: Mar. 12, 2020

(87) PCT Pub. No.: WO2019/052866

PCT Pub. Date: Mar. 21, 2019

(65) Prior Publication Data

US 2020/0278099 A1 Sep. 3, 2020

Related U.S. Application Data

(63) Continuation of application No. PCT/EP2018/073825, filed on Sep. 5, 2018.

(30) Foreign Application Priority Data

Sep. 12, 2017 (EP) ..... 17190620

(51) Int. Cl.

| | |
|---|---|
| ***F21S 43/237*** | (2018.01) |
| ***F21S 43/13*** | (2018.01) |
| ***F21S 43/27*** | (2018.01) |
| *F21Y 115/30* | (2016.01) |

(52) U.S. Cl.

CPC ..... *F21S 43/237* (2018.01); *F21S 43/13* (2018.01); *F21S 43/27* (2018.01); *F21Y 2115/30* (2016.08)

(58) Field of Classification Search

CPC ..... F21Y 2115/30; F21S 43/27; F21S 43/13; F21S 43/237

See application file for complete search history.

(56) References Cited

U.S. PATENT DOCUMENTS

| | | | |
|---|---|---|---|
| 5,122,933 | A | 6/1992 | Johnson |
| 5,311,410 | A | 5/1994 | Hsu et al. |
| 2018/0172239 | A1 | 6/2018 | Wacker et al. |

FOREIGN PATENT DOCUMENTS

| | | | |
|---|---|---|---|
| DE | 196 25 021 | A1 | 1/1998 |
| WO | 2007/047304 | A1 | 4/2007 |

*Primary Examiner* — Anne M Hines

(74) *Attorney, Agent, or Firm* — Volpe Koenig

(57) ABSTRACT

A holder for a vehicle signaling light and a vehicle signaling light assembly are described. A holder for a vehicle signaling light includes a carrier rail with a hollow section. The carrier rail is coupled with at least two guiding structures. The guiding structures are arranged to guide a flexible light distribution fiber within the hollow section.

20 Claims, 5 Drawing Sheets

HOLDER FOR VEHICLE SIGNALING LIGHT

FIELD OF THE INVENTION

The invention relates to a holder for vehicle signaling light. The invention further relates to a vehicle signaling light assembly comprising the holder and a vehicle signaling light comprising the vehicle signaling light assembly.

BACKGROUND OF THE INVENTION

Recent vehicle signaling lights like, for example, vehicle rear lights comprise light-emitting diodes (LED). The small size of LEDs enables customization of light patterns which can be provided by means of such vehicle light sources.

SUMMARY OF THE INVENTION

It is an object of the present invention to enable a flexible and cost-effective design of vehicle signaling lights, especially vehicle signaling lights comprising semiconductor light sources like LEDs or lasers.

The invention is defined by the independent claims. The dependent claims define advantageous embodiments.

According to a first aspect a holder for a vehicle signaling light is provided. The holder for the vehicle signaling light comprises a carrier rail with a hollow section. The carrier rail is coupled with at least two guiding structures. The guiding structures are arranged to guide a flexible light distribution fiber within the hollow section.

The guiding structures are arranged to position the flexible light distribution fiber along a predefined path within the hollow section. The at least two guiding structures may be arranged to exert tension or compression to the flexible light distribution fiber in order to guide the flexible light distribution fiber along the predefined path. The guiding structures may therefore be arranged to clamp the flexible light distribution fiber. The guiding structures may alternatively or in addition be arranged to redirect the flexible light distribution fiber (provide a predefined curvature). The carrier rail may comprise a material enabling reliable guiding of the flexible light distribution fiber. The material may have to be sufficiently stiff in order to provide sufficient tension or compression. The material may, for example, comprise metals like aluminum or plastics. A cross-section of the hollow section may be arranged to provide special lighting effects when illuminated by means of the flexible light distribution fiber. The cross-section of the hollow section may, for example, vary along the extension of the carrier. Alternative or in addition a relative position of the flexible light distribution fiber may vary within cross-section of the hollow section along the extension of the carrier. The cross-section of the carrier rail is adapted to the respective application. The cross-section may, for example, be rectangular, elliptical, circular and the like. The holder enables complex guiding of the flexible light distribution fiber especially in a three-dimensional bended arrangement. The holder is arranged to be coupled to a corresponding socket of the vehicle. The material of the holder may be chosen in accordance with the socket. The material may, for example, be flexible such that the socket defines the shape of the holder. The socket may support the holder in this case to provide sufficient stability to guide the flexible light distribution fiber. The holder may in this case be placed in the socket in a first step. The light guiding structures may be placed in and coupled with the holder in accordance with the shape of the holder defined by the socket in a second step and the light distribution fiber may by coupled to the guiding structures in a third step. The holder may alternatively be arranged in a predefined shape such that guiding structures and flexible light distribution fiber are pre-assembled.

The guiding structures may be an integrated part of the carrier rail or may be coupled to the carrier rail in a removable way. The guiding structures may, for example, be narrowings or constrictions of the hollow section. The guiding structures may be arranged to optically interact with the flexible light distribution fiber. Optical interaction with the flexible lighting solution structure may be used to provide special light effects (e.g. more or less brightness). One or more of the guiding structures may alternatively be arranged such that the flexible light distribution fiber appears to hover within the carrier rail. The guiding structure or structures are in this case arranged to be nearly invisible especially if a light emitting light source is coupled to the flexible light distribution fiber.

At least a part of hollow section may comprise a reflective surface structure. The reflective surface structure may cover the whole inner surface of the hollow section. The reflective surface structure may be specular and/or diffuse reflective. The material of the carrier rail may be arranged to provide the reflectivity. Alternatively or in addition one or more surface coatings may be provided in the hollow section in order to enable manipulation (reflection, redirection, absorption etc.) of the light emitted by the flexible light distribution fiber.

The inner surface of the hollow section comprises may alternatively or in addition comprise at least one light tuning structure. The light tuning structure may be used to provide a localized deviation of the light distribution/appearance (e.g. specularly reflective ripples, prismatic structures, structures comprising light converting materials which are arranged to convert received light in a first wavelength range to converted light in a second wavelength range and the like).

The hollow section has a cross-section with an area between 50 $mm^2$ and 1600 $mm^2$, preferably between 150 $mm^2$ and 1000 $mm^2$ and most preferably between 300 $mm^2$ and 700 $mm^2$. The cross-section of the hollow section may, for example have a parabolic or semicircular shape. A radius of a semicircular cross-section may, for example, be in the range between 3 mm and 20 mm, preferably between 5 mm and 15 mm.

According to a second aspect a vehicle signaling light assembly is provided. The vehicle signaling light assembly comprises the holder according to any embodiment described above and the flexible light distribution fiber guided by the guiding structures. The flexible light distribution fiber is arranged to distribute light received via a light in-coupling surface across the linear extension of the flexible light distribution fiber. Material properties may therefore be arranged in accordance with the intended light distribution and the intended path of the flexible light distribution fiber within the carrier rail. The flexible light distribution fiber may, for example, comprise materials selected out of the group plastic materials, silicones and glass. The properties of the material or material composition may vary along the extension of the flexible light distribution fiber. The properties of the material or material composition may especially be arranged to enable a defined light distribution along the extension of the flexible light distribution fiber if the light source with a predefined intensity is coupled to the light in-coupling surface. The material or material composition may, for example, comprise scattering particles which are distributed within the material of the material composition in order to provide the intended lighting effect (e.g. homogeneous light emission along the linear extension of the flexible light distribution fiber). The material or the material composition of the flexible light distribution fiber may be doped with light converting particles. The light converting particles may be arranged to locally convert light of a first wavelength range to the light of a second wavelength range, wherein the second wavelength range is in a longer wavelength range than the first wavelength range. The light in-coupling surface may be one end surface of the flexible light distribution fiber. Alternatively, a light in-coupling structure may be provided at one or both end surfaces.

The flexible light distribution fiber may have a cross section with an area between 0.5 $mm^2$ and 20 $mm^2$, preferably between 1.50 $mm^2$ and 10 $mm^2$ and most preferably between 3 $mm^2$ and 7 $mm^2$. A cross-section of the flexible light distribution fiber may be arranged to provide a predefined lighting effect. The cross-section of the flexible light distribution fiber may vary along the extension of the flexible light distribution fiber. The flexible light distribution fiber may, for example, have a circular cross-section with a diameter between 0.5 mm and 5 mm, preferably between 1 mm and 4 mm and most preferably between 2 mm and 3 mm.

The flexible light distribution fiber may comprise at least one local light scattering structure. The light scattering structure is arranged to couple out light at the location of the light scattering structure. The light scattering structure may, for example, comprise a local constriction or rising of the flexible light distribution fiber.

According to a third aspect a vehicle signaling light is provided. The vehicle signaling light comprises at least one vehicle signaling light assembly in accordance with any embodiment described above and a light source. The light source is arranged to couple in light in a lateral end surface of the light distribution fiber. The light source may be a semiconductor light source chosen out of the group LED or semiconductor laser (e.g. blue light emitting side emitter).

The light source may be arranged to emit light in the visible and outside the visible spectrum (especially infrared). Optionally light sources with different emission spectrum may be coupled to one or both end surface.

The vehicle signaling light may further comprise an electrical driver for driving the light source. The electrical driver comprises an electrical interface for providing electrical power and/or control signals in order to control the vehicle signaling light. The electrical driver may be integrated in the holder or be a separate device connected to the light source(s).

It shall be understood that a preferred embodiment of the invention can also be any combination of the dependent claims with the respective independent claim.

Further advantageous embodiments are defined below.

BRIEF DESCRIPTION OF THE DRAWINGS

These and other aspects of the invention will be apparent from and elucidated with reference to the embodiments described hereinafter.

The invention will now be described, by way of example, based on embodiments with reference to the accompanying drawings.

In the drawings:

FIG. 1 shows a principal sketch of a top view of a first vehicle signaling light assembly FIG. 2 shows a principal sketch of a cross-section of the first vehicle signaling light assembly along line A-A in FIG. 1

FIG. 3 shows a principal sketch of a cross-section of the first vehicle signaling light assembly along line B-B in FIG. 1

FIG. 4 shows a principal sketch of a cross-section of a second vehicle signaling light assembly along line A-A similar as shown in FIG. 1

FIG. 5 shows a principal sketch of a cross-section of a third vehicle signaling light assembly along line A-A similar as shown in FIG. 1

FIG. 6 shows a principal sketch of a cross-section of the third vehicle signaling light assembly along line C-C shown in FIG. 5

FIG. 7 shows a principal sketch of a top view of a first vehicle signaling light In the Figures, like numbers refer to like objects throughout. Objects in the Figs. are not necessarily drawn to scale.

DETAILED DESCRIPTION OF EMBODIMENTS

Various embodiments of the invention will now be described by means of the Figures.

Figure 1:
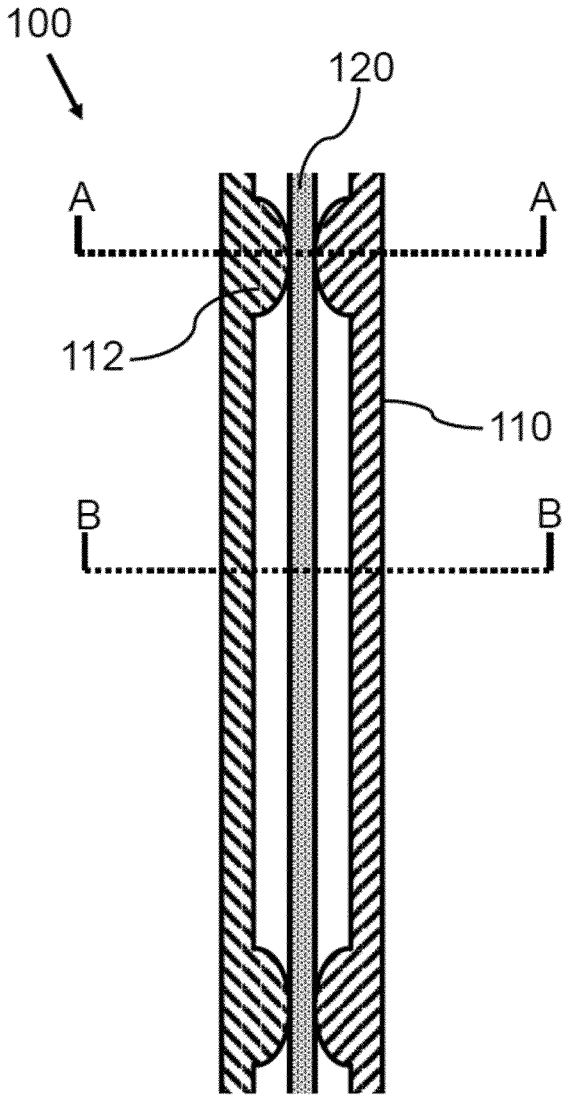

FIG. 1 shows a principal sketch of a top view of a first vehicle signaling light assembly 100. The vehicle signaling light assembly 100 comprises a carrier rail 110 and two guiding structures 112. A flexible light distribution fiber 120 consisting of a transparent material or material composition (within the wavelength range of the light source to be coupled to the flexible light distribution fiber 120) with scattering particles is clamped by the two guiding structures 112. The flexible light distribution fiber 120 is stretched between the two guiding structures 112 such that the flexible light distribution fiber 120 is arranged along a straight line with in the carrier rail 110 and does not touch the carrier rail 110 within the hollow section of the carrier rail 110 (see FIG. 3). The carrier rail 110 may alternatively be bended such that the flexible light distribution fiber 120 follows a complex three-dimensional path in accordance with the guiding by means of the guiding structures 112 coupled with the carrier rail 110. The light guiding structures 112 are in this case arranged to provide the intended tension or compression such that the flexible light distribution fiber 120 follows the intended path.

Figure 2:
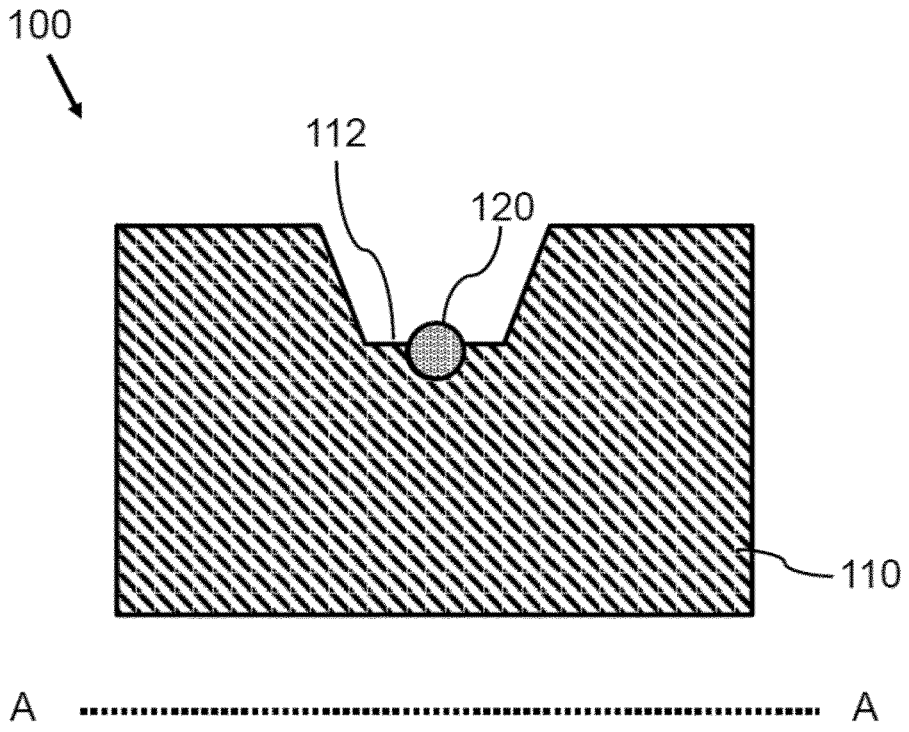

FIG. 2 shows a principal sketch of a cross-section of the first vehicle signaling light assembly 100 along line A-A shown in FIG. 1. The carrier rail 110 does have a rectangular cross-section and the guiding structure 112 is a narrowing or constriction within the carrier rail 110. The flexible light distribution fiber 120 has a circular cross-section. The flexible light distribution fiber 120 is clamped in a corresponding slot of the guiding structure 112.

Figure 3:
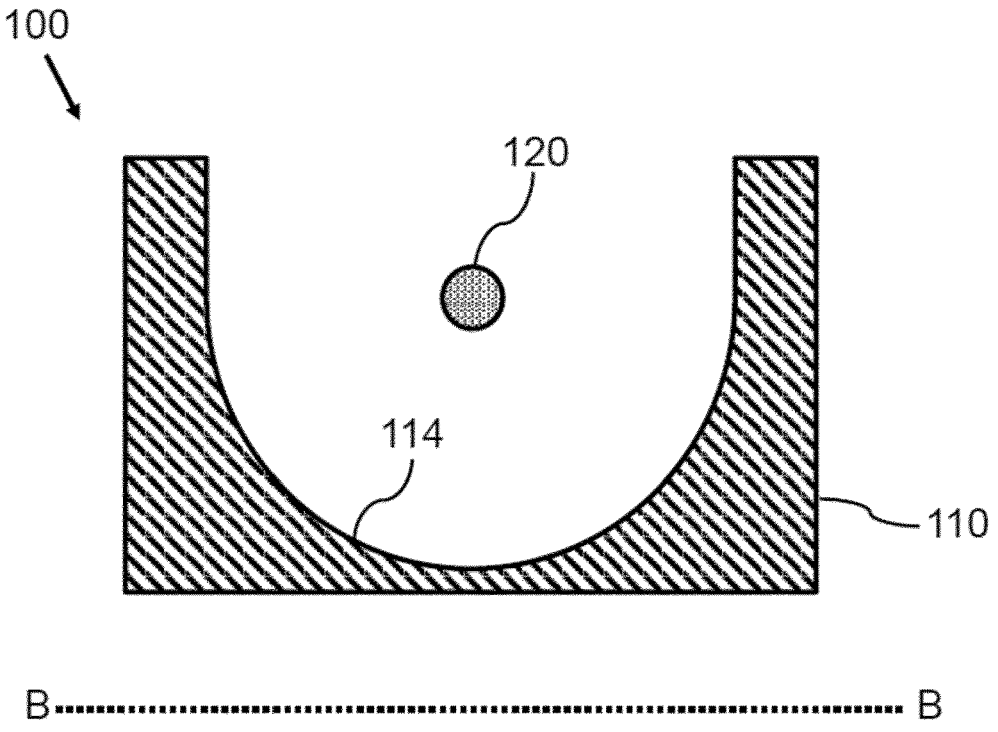

FIG. 3 shows a principal sketch of a cross-section of the first vehicle signaling light assembly 100 along line B-B shown in FIG. 1. The hollow section does have a U-shaped cross-section wherein the lower part which is limited by the carrier rail 110 has a cross-section of a semicircle. The guiding structures 112 shown in FIG. 1 are arranged such that a center point of the circular flexible light distribution fiber 120 is arranged in a center point of the semicircle. The inner surface of the hollow section of the carrier rail 112 is covered by means of a reflective surface structure 114 which is in this case diffusely reflective in order to provide a homogeneous light distribution.

Figure 4:
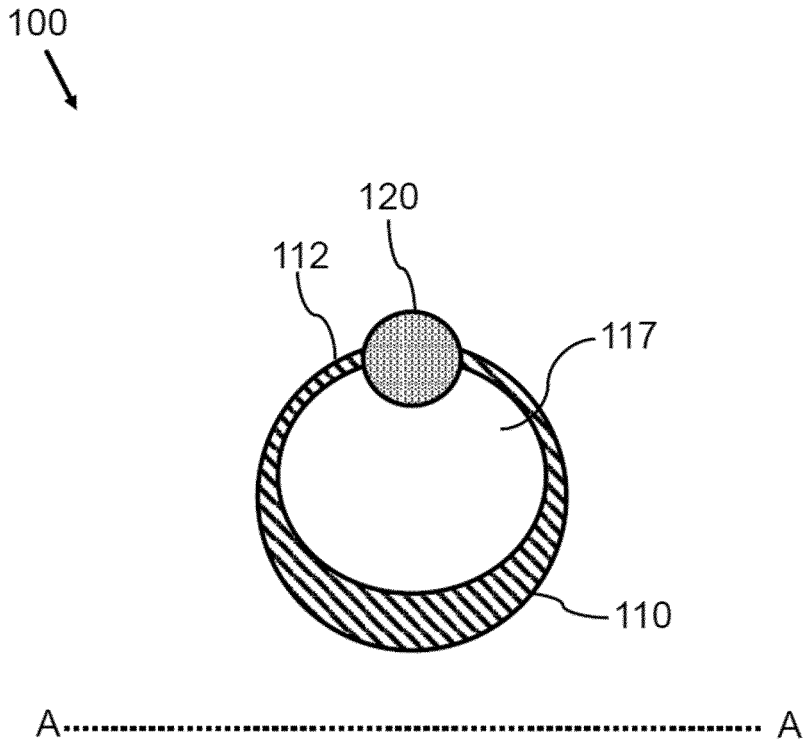

FIG. 4 shows a principal sketch of a cross-section of a second vehicle signaling light assembly 100 along line A-A similar as shown in FIG. 1. The carrier rail 110 has a circular cross-section and the guiding structure 112 is a narrow slit in the hollow tube building the carrier rail 110. The flexible light distribution fiber 120 is clamped in the narrow slit and the inner surface of the tube is used as light mixing chamber 117 in order to provide a predefined lighting effect if the light is emitted via the flexible light distribution fiber 120. The slit widens outside the guiding structure 112 such that the flexible light distribution fiber 120 does not longer touch the carrier rail 110.

Figure 5:
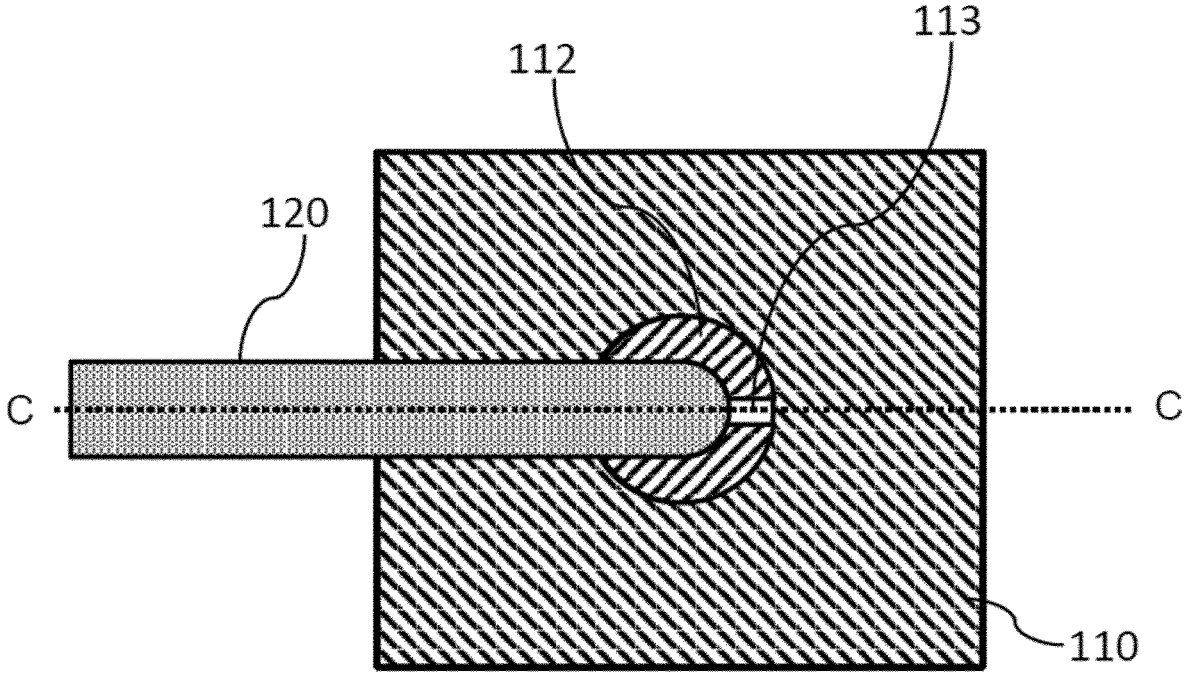
Figure 6:
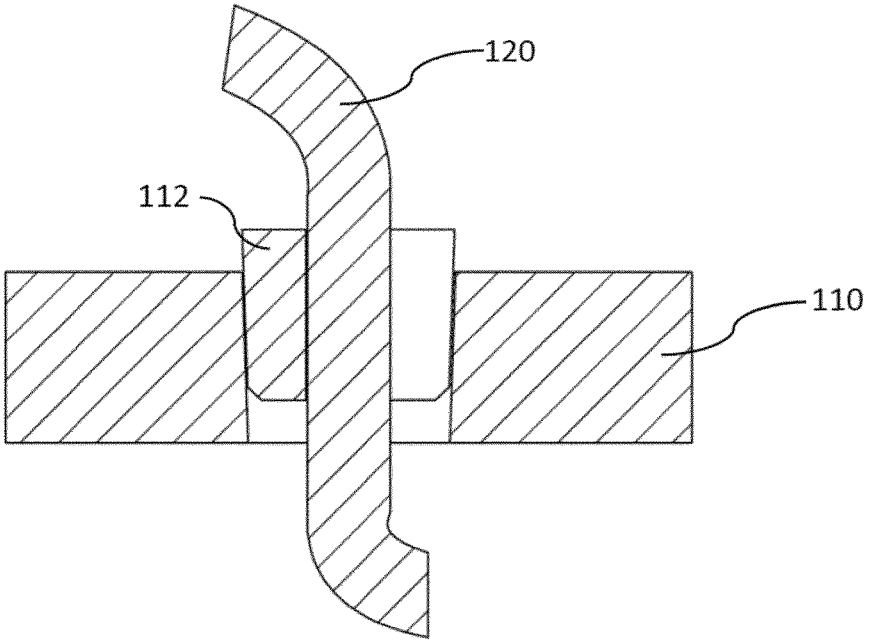

FIG. 5 shows a principal sketch of a cross-section of a third vehicle signaling light assembly along line A-A similar as shown in FIG. 1. The part of the carrier rail 110 which is directly coupled with a guiding structure 112 is in this embodiment characterized by a hole in which the guiding structure 112 can be pressed in order to clamp a flexible light distributions fiber 120. Clamping can be used in order to excerpt tension or compression between two guiding structures 112. The guiding structure 112 is in this embodiment a kind of clamping ring with a gap 113. The clamping ring is conically shaped such that the clamping ring closes and clamps the flexible light distribution fiber 120 when pushed or pressed into the hole of the carrier structure 110 as shown in FIG. 6 showing a principal sketch of a cross-section of the third vehicle signaling light assembly along line C-C shown in FIG. 5. The hollow section of the carrier rail 110 may similar as discussed with respect to FIG. 3.

Figure 7:
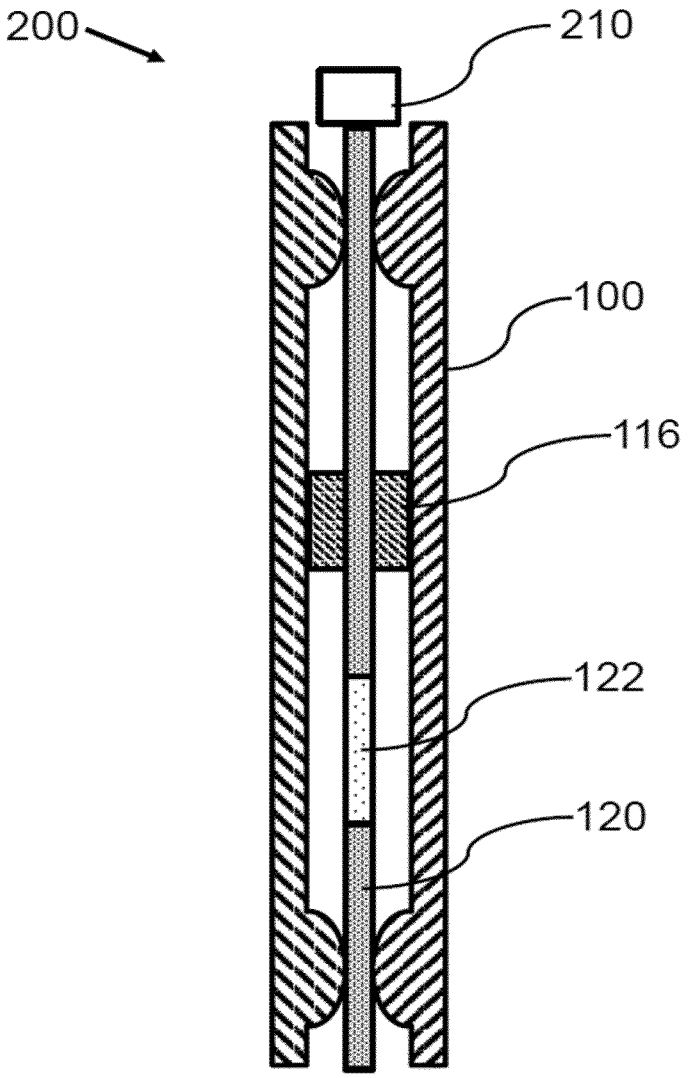

FIG. 7 shows a principal sketch of a top view of a first vehicle signaling light 200. The first vehicle signaling light 200 comprises a vehicle light assembly similar as discussed with respect to FIG. 1. A light in-coupling surface of the flexible light distribution fiber 120 is coupled to a light source 210. The light source 210 is in this case a laser emitting blue light. A part of the hollow section of the carrier rail 110 is covered with a light tuning structure 116 in order to provide a predefined lighting distribution by means of light distributed by the flexible lighting distribution fiber 120. The flexible light distribution fiber 120 comprises a light scattering structure 122 which increases light outcoupling at a defined location of the flexible light distribution fiber 120. The intensity of the light source 210 and the light distribution properties of the flexible light distribution fiber 120 are arranged such that the intensity of the light distributed by the light distribution fiber 120 (besides at the location of the light scattering structure 122) is essentially constant along the linear extension of the flexible light distribution fiber 120. An end surface of the flexible light distribution fiber 120 which is not coupled to the light source 212 may be covered by a reflective coating such that optical losses may be reduced. Alternatively a second light source 210 may be coupled to the second end surface of the flexible light distribution fiber 120.

While the invention has been illustrated and described in detail in the drawings and the foregoing description, such illustration and description are to be considered illustrative or exemplary and not restrictive.

From reading the present disclosure, other modifications will be apparent to persons skilled in the art. Such modifications may involve other features which are already known in the art and which may be used instead of or in addition to features already described herein.

Variations to the disclosed embodiments can be understood and effected by those skilled in the art, from a study of the drawings, the disclosure and the appended claims. In the claims, the word "comprising" does not exclude other elements or steps, and the indefinite article "a" or "an" does not exclude a plurality of elements or steps. The mere fact that certain measures are recited in mutually different dependent claims does not indicate that a combination of these measures cannot be used to advantage.

Any reference signs in the claims should not be construed as limiting the scope thereof.

LIST OF REFERENCE NUMERALS

100 vehicle signaling light assembly
110 carrier rail
112 guiding structure
113 gap of clamping ring
114 reflective surface structure
116 light tuning structure
117 light mixing chamber
120 flexible light distribution fiber
122 light scattering structure
200 vehicle signaling light
210 light source

The invention claimed is:

1. A holder for a vehicle signaling light comprising:
a carrier rail with a hollow section, the hollow section having a cross section with an area between 50 $mm^2$ and 1600 $mm^2$;
a flexible light distribution fiber within the hollow section and having a cross section with an area between 0.5 $mm^2$ and 20 $mm^2$; and
at least two guiding structures coupled with the carrier rail and arranged to provide tension or compression to clamp the flexible light distribution fiber within the hollow section such that the flexible light distribution fiber follows an intended path.

2. The holder according to claim 1, wherein the at least two guiding structures are narrowings of the hollow section.

3. The holder according to claim 1, wherein at least a part of hollow section comprises a reflective surface structure.

4. The holder according to claim 1, wherein an inner surface of the hollow section comprises at least one light tuning structure.

5. The holder according to claim 1, wherein the area of the cross section of the hollow section is between 150 $mm^2$ and 1000 $mm^2$.

6. The holder according to claim 1, wherein the area of the cross section of the hollow section is between 300 $mm^2$ and 700 $mm^2$.

7. The holder according to claim 1, wherein the cross section of the hollow section varies along a length of the carrier.

8. The holder according to claim 1, wherein the cross section of the hollow section has at least one of a rectangular shape, an elliptical shape and a circular shape.

9. The holder according to claim 1, wherein the at least two guiding structures are one of integral parts of the carrier rail or removably coupled to the carrier rail.

10. The holder according to claim 1, wherein an inner surface of the hollow section comprises at least one light tuning structure.

11. A vehicle signaling light assembly comprising:
a holder comprising:
a carrier rail with a hollow section, the hollow section having a cross section with an area between 50 $mm^2$ and 1600 $mm^2$,
a flexible light distribution fiber within the hollow section and having a cross section with an area between 0.5 $mm^2$ and 20 $mm^2$, and
at least two guiding structures coupled with the carrier rail and arranged to provide tension or compression to clamp the flexible light distribution fiber within the hollow section such that the flexible light distribution fiber follows an intended path.

12. The vehicle signaling light assembly according to claim 11, wherein the area of the cross section of the flexible light distribution fiber is between 1.50 $mm^2$ and 10 $mm^2$.

13. The vehicle signaling light assembly according to claim 11, wherein the flexible light distribution fiber comprises at least one local light scattering structure.

14. The vehicle signaling light assembly according to claim 11, wherein the area of the cross section of the flexible light distribution fiber is between 3 $mm^2$ and 7 $mm^2$.

15. The vehicle signaling light assembly according to claim 11, wherein the at least two guiding structures are narrowings of the hollow section.

16. The vehicle signaling light assembly according to claim 11, wherein at least a part of hollow section comprises a reflective surface structure.

17. The vehicle signaling light assembly according to claim 11, wherein an inner surface of the hollow section comprises at least one light tuning structure.

18. A vehicle signaling light comprising:

at least one vehicle signaling light assembly each comprising:

a carrier rail with a hollow section, the hollow section having a cross section with an area between 50 $mm^2$ and 1600 $mm^2$, a flexible light distribution fiber within the hollow section and having a cross section with an area between 0.5 $mm^2$ and 20 $mm^2$, and at least two guiding structures coupled with the carrier rail and arranged to provide tension or compression to clamp the flexible light distribution fiber within the hollow section such that the flexible light distribution fiber follows an intended path; and a light source arranged to couple in light in a lateral end surface of the light distribution fiber.

19. The vehicle signaling light according to claim 18, wherein the light source is a semiconductor light source.

20. The vehicle signaling light according to claim 18, further comprising an electrical driver configured to drive the light source.

* * * * *